US005257936A

United States Patent [19]

Ambrosi et al.

[11] Patent Number: 5,257,936

[45] Date of Patent: Nov. 2, 1993

[54] RIFLE-FIRABLE TRAINING GRENADE AND RIFLE-GRENADE FIRING INSTRUCTION SYSTEM

[75] Inventors: Francois Ambrosi, Bourges, France; Pierre Laurent, Cleadon, United Kingdom; Thierry Dupré, Bourges, France

[73] Assignee: Luchaire Defense S.A., Saint Cloud, France

[21] Appl. No.: 46,341

[22] Filed: Apr. 13, 1993

Related U.S. Application Data

[63] Continuation of Ser. No. 658,663, Feb. 21, 1991, abandoned.

[30] Foreign Application Priority Data

Feb. 21, 1990 [FR] France ..... 90 02116

[51] Int. Cl.[5] ..... F42B 1/00

[52] U.S. Cl. ..... 434/11; 434/12; 434/15; 102/529

[58] Field of Search ..... 434/11, 12, 15; 273/218, 365, 418, 420; 446/397–403; 102/483, 498, 529

[56] References Cited

U.S. PATENT DOCUMENTS

| | | | |
|---|---|---|---|
| 3,156,187 | 11/1964 | Batou . | |
| 3,289,585 | 12/1966 | Rudolph et al. | 102/529 |
| 3,385,215 | 5/1968 | Jungermann | 102/529 |
| 4,711,180 | 12/1987 | Smolnik | 102/529 |

*Primary Examiner*—Richard J. Apley
*Assistant Examiner*—Glenn E. Richman
*Attorney, Agent, or Firm*—Young & Thompson

[57] ABSTRACT

Completely inert training grenade intended to be fired by a rifle and a propellant cartridge, comprising a metal tube (1) equipped with a rear stabilizing tail unit (2) and with a front solid part (3) which closes off the tube. This front part (3) carries a hollow nose (4) containing a marking substance (5), this nose (4) being fastened removably by engagement to the front solid part (3) of the tube. The nose (4) is sufficiently resistant to withstand the shot, but is destructible on impact. The solid front part (3) of the tube is produced in one piece with the tube, the diameter of this part being substantially equal to or slightly larger than that of the rest of the tube. The nose (4) engaged on this solid front part has an inner annular shoulder (11) bearing on the front surface (3*a*) of the solid part (3) of the tube, and the front end of the nose (4) is flat. The nose (4) is shaped so that its wall can break in the event of its impact on the ground.

14 Claims, 2 Drawing Sheets

RIFLE-FIRABLE TRAINING GRENADE AND RIFLE-GRENADE FIRING INSTRUCTION SYSTEM

This application is a continuation of application Ser. No. 07/658,663, filed 2/21/91, now abandoned.

The present invention relates to a training grenade intended to be fired by means of a rifle. Such a completely inert grenade comprises a metal tube equipped with a rear stabilizing tail unit and with a front solid part which closes off said tube, this front part carrying a hollow nose containing an inert marking substance.

The marking substance contained in the hollow nose can be plaster, barium sulfate or any other powdery or liquid product.

The invention is also concerned with a rifle-grenade firing instruction system comprising the above-mentioned training grenade and its associated launching cartridge.

In known embodiments, the nose is fixed to the metal tube which is commonly called a sleeve tube or fusion ball.

On impact, the nose is destroyed and the marking substance gives a visual indication of this.

There are known training grenades comprising a sleeve tube the interior of which has a bullet trap absorbing the bullet from a live cartridge and which also require the addition of propellant powder.

Both this bullet trap and the powder are destroyed at each firing, and therefore no part of these grenades is recoverable.

Such training grenades are consequently costly.

Moreover, such training grenades, because they require the use of live cartridges for firing them, present a danger to the training personnel and need very large safety clearances for the firing range.

On the other hand, there are known training grenades which can be fired with propellant, that is to say blank, cartridges, but these grenades are equipped with a pyrotechnic marker.

These grenades thus avoid the abovementioned dangers associated with the use of live cartridges.

However, these training grenades too are not recoverable, in so far as the pyrotechnic marker has to be reloaded, thereby likewise making them very expensive and moreover risking causing fires in summer in the brush of the firing ranges.

Furthermore, these grenades are fired by means of a propellant cartridge which does not have the external shape of a true live cartridge, and therefore they cannot be used in the loaders of automatic rifles and do not ensure an automatic re-cocking of these rifles.

U.S. Pat. No. 3,156,187 makes known a training grenade, of which the hollow nose containing the marking substance is engaged on a rubber block of wide cross-section which is fastened to the front of the tube.

The nose terminates in a rounded tip. This nose has a conical shape of relatively high angle, so that, in the event of an impact occurring at a low angle of incidence, this nose risks not being broken. In this case, the location of the impact is not marked.

The object of the present invention is to provide a training grenade, the nose of which is capable of breaking, even in the event of an impact of very low incidence and on very loose ground, without the solid front part of the tube risking being damaged under the effect of the shock after the destruction of the nose.

The invention is thus aimed at a training grenade intending to be fired by means of a rifle and of a propellant cartridge, this grenade comprising a metal tube equipped with a rear stabilizing tail unit and with a front solid part which closes off said tube, this front part carrying a hollow nose containing a marking substance, this nose being fastened removably by engagement to the front solid part of the tube, this nose being sufficiently resistant to withstand the shot, but being destructible on impact.

According to the invention, the solid front part of the tube is produced in one piece with this tube, the diameter of this part being substantially equal to or slightly larger than that of the rest of the tube, the nose engaged on this solid front part has an inner annular shoulder bearing on the front surface of the solid part of the tube, and the front end of the nose has a plane surface i.e. is flat, this nose being shaped so that its wall can break under its impact on the ground.

Thus, after impact, it is possible to remove the destroyed nose from the tube easily, so that the latter can be recovered. A new nose can be mounted on the tube so recovered, in order to obtain a training grenade ready for use.

The training grenade according to the invention is thus inexpensive, since the most costly part, that is to say the tube, can be recovered after each shot.

The front solid part of the tube gives the latter a high mechanical resistance which allows it to absorb the shocks on impact. Moreover, this front solid part of the tube is capable of trapping a real bullet fired inadvertently. This solid part thereby guarantees the soldiers in training a high degree of safety.

Furthermore, during impact, the front of the solid part of the tube does not risk being damaged as a result of the inner annular shoulder of the nose which protects it.

On the other hand, because the front of the nose has a plane surface, during the impact this will transmit to the nose an axial compressive force which will bring about its destruction, even if the angle of incidence is very low and if the ground is very loose.

According to an advantageous version of the invention, the nose has an outer wall possessing thinned zones.

These thinned zones embrittle the wall of the nose, so that the latter can burst easily on impact, even on loose ground. By means of these embrittling zones, the nose is destroyed in such a way that the tube can easily be recovered.

According to a preferred version of the invention, said thinned zones consist of grooves made on the surface of the wall of the nose.

Preferably, said grooves extend in the longitudinal direction of the nose.

According to a preferred embodiment of the invention, the nose has a rear connector which engages on the solid part of the tube. This engagement makes it possible both to remove the destroyed nose so as to recover the tube and to reinstall a new nose on the latter.

The nose can be produced in one piece by molding from a breakable plastic, such as polystyrene.

Other particular features and advantages of the invention will also emerge from the description which follows.

In the accompanying drawings given by way of non-limiting example:

Figure 1:
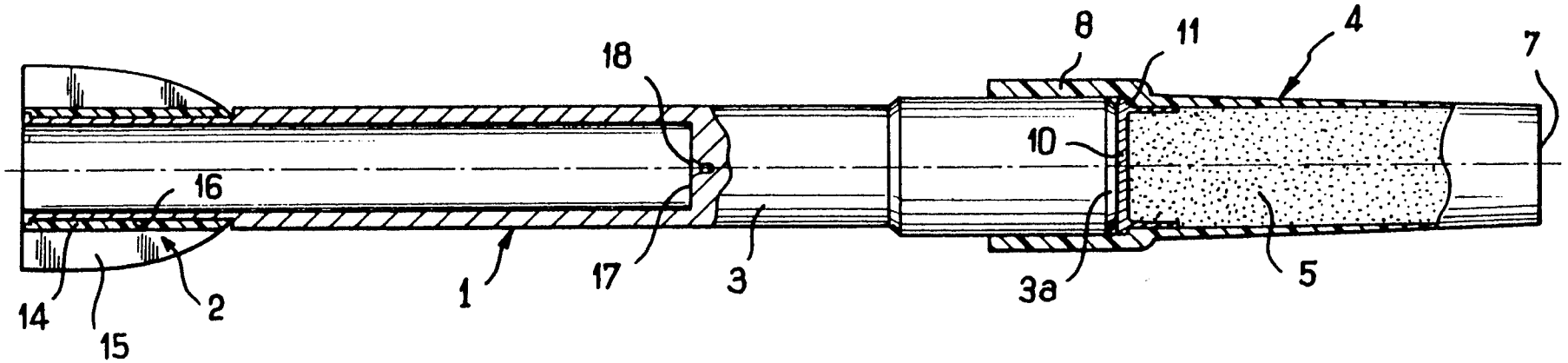
FIG. 1 is a plan view of the training grenade according to the invention with partial longitudinal sections through the tube and the nose.
Figure 2:
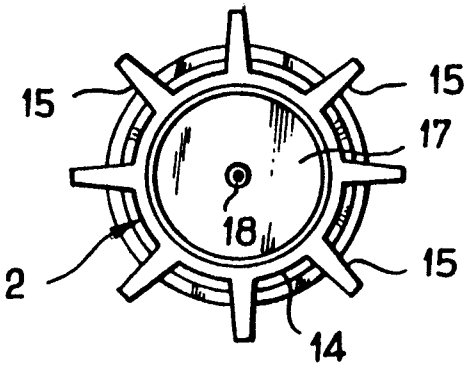
FIG. 2 is an end view of the grenade on the tail-unit side.

In the embodiment of FIG. 1, the training grenade intended to be fired by means of a rifle comprises a metal tube 1 equipped with a rear stabilizing tail unit 2 and with a front solid part 3 which closes off said tube. This solid front part carries a hollow nose 4 containing a marking substance 5.

According to the invention, the nose 4 is fastened removably to the front solid part 3 of the tube 1, this nose 4 being sufficiently resistant to withstand the shot, but being destructible on impact.

The tube 1 has, for example, a total length equal to 235 mm and a diameter equal to 33 mm.

Figure 3:
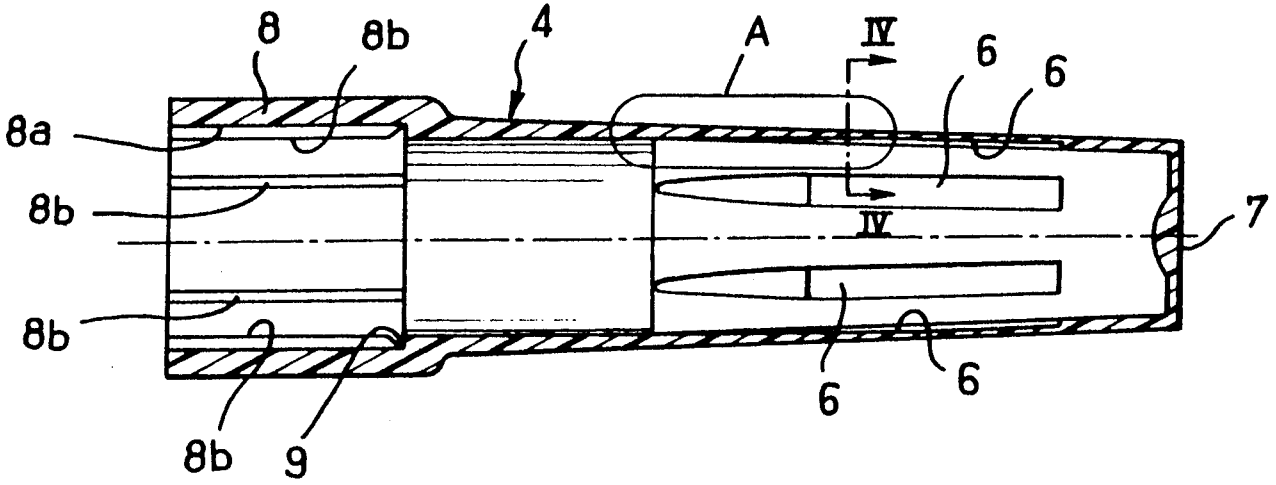
FIG. 3 is a view in longitudinal section of the nose.

FIG. 3 shows that the nose 4 has a wall possessing thinned zones 6 consisting of grooves made on the inner surface of the wall of the nose 4 and in the longitudinal direction of the latter. In the region of these grooves 6, the number of which is equal to 6 in the example shown, the thickness of the wall of the nose 4 is reduced substantially by half.

Figure 4:
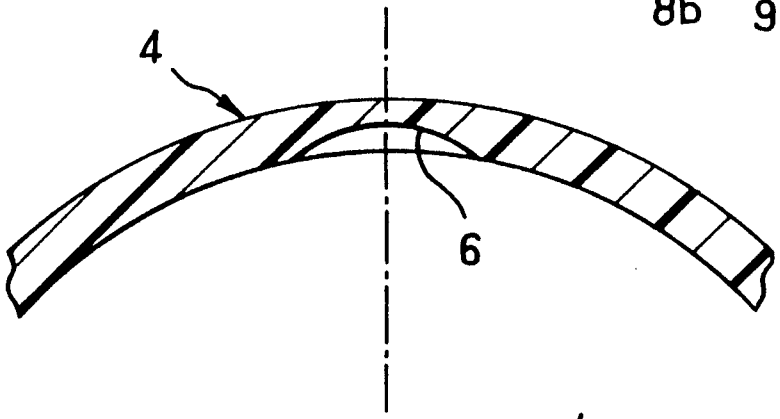
FIG. 4 is a sectional view on an enlarged scale in the plane IV—IV of FIG. 3.

Furthermore, FIG. 4 shows that the cross-section of the grooves 6 is in the form of an arc of a circle, the radius of curvature of which can be of the order of 4 mm.

Figure 5:
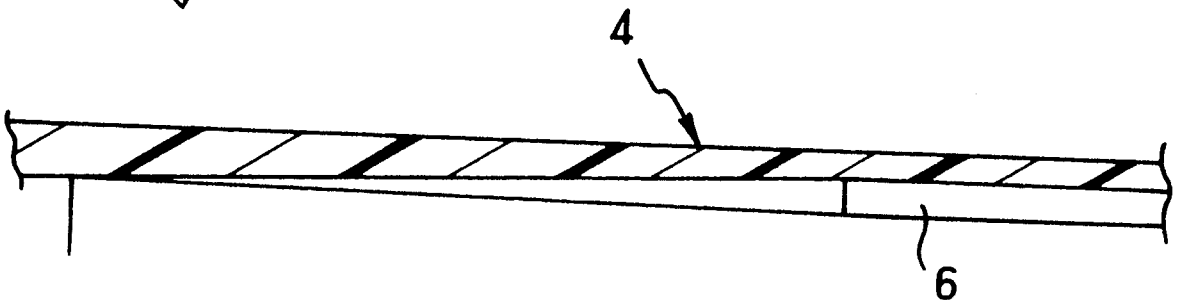
FIG. 5 is a view on an enlarged scale of the detail A of FIG. 3.

FIG. 5 shows, on the other hand, that the depth of the grooves 6 increases progressively from the rear towards the front of the nose 4 and stops at some distance from the front end 7 of the nose.

In the example illustrated in FIGS. 1 and 3, the nose 4 has a rear connector 8 which engages on the solid part 3 of the tube 1.

The thickness of the wall of this rear connector 8 is larger than that of the wall of the front part 4 of the nose.

To make it easier particularly to engage the connector 8 of the nose 4 onto the solid front part 3 of the tube, the inner surface 8*a* of this connector has a series of ribs 8*b* parallel to the axis of the nose 4. These ribs 8*b* have a height of the order of a few tenths of a millimeter. These ribs 8*b* make it possible to center the nose 4 exactly relative to the tube 1 and provide air passages which prevent a compression of air during the engagement of the connector 8 onto the tube 1.

Moreover, the front part 4 of the nose has a slightly frustoconical shape. The thickness of the wall of the latter decreases progressively between the large base and the plane small base corresponding to the end 7 of the nose of said frustoconical part. This plane small base forms a sharp edge with the lateral wall of the nose.

In the example illustrated, the nose 4, including the rear connector 8, is molded in one piece from relatively breakable plastic, such as polystyrene.

The inner surface 8*a* (see FIG. 3) of the rear connector 8 of the nose 4 intended to be engaged on the solid part 3 of the tube 1 possesses, at its end adjacent to the actual nose, an annular shoulder 9, on which bears a plug, removable or not, or a closing plate 10 (see FIG. 1).

This plug or plate 10 is produced from plastic, flexible or not, and bears on the shoulder 9 of the connector 8. It is engaged, adhesively bonded or welded onto this shoulder 9, as appropriate.

The tube 1 is produced in one piece from metal or alloy, such as aluminum or another shock-resistant light alloy. It is produced in such a way that it is capable of trapping a bullet fired in error and of swelling the solid part 3 sufficiently to alert the firing officer of this error in a visible and unconcealable way. Moreover, the tube is protected by a colored surface treatment which cracks under the action of the abovementioned swelling, thus producing a highly visible ring.

As can be seen in FIG. 1, the rear tail unit 2 of the tube 1 comprises a bush 14 carrying fins 15. This bush 14 is mounted in an annular recess 16 formed at the rear of the tube 1 and retaining the tail unit 2 axially.

This tail unit 2 is advantageously molded in one piece from plastic.

Furthermore, FIG. 1 shows that the bottom 17 of the tube 1 has an axial cavity 18 of a size matched to the end of a bullet. This cavity 18 possesses, at its entrance, an outwardly widened conical surface which is extended forwards by a cylindrical blind hole of a diameter equal to 2 mm. This cavity 18 serves for trapping the bullet of a live cartridge fired in error instead of a blank propellant cartridge.

The nose 4 of the training grenade according to the invention can, as an example, have the following characteristics:

type of material:polystyrene
length:140 mm
inside diameter of the connector 8:33 mm
thickness of the wall of the nose:3 mm maximum, 1.5 mm minimum
depth of the grooves 6:0.75 mm
length of the grooves 6:60 mm The training grenade just described has ballistic characteristics identical to those of a live grenade.

Despite the relative brittleness of the nose 4, the latter withstands the high acceleration which it experiences during firing.

During this acceleration, the forces are essentially absorbed by the inner shoulder 9 of the connector 8, on which the rim 11 of the plug or late 10 and the front end 3A of the solid part 3 of the tube come to bear. This shoulder 9 associated with a wall of relatively large thickness of the connector 8 allows the nose 4 to withstand the shock and also protects the solid part 3 in the event of the impact on a very hard solid target.

On impact of the grenade even on loose ground, the nose 4 bursts and the marking powder 5 spreads over the ground.

This bursting of the nose 4 is the result of the choice of the material of which it is made, the thickness of its wall, the presence of the embrittling zones 6 and the form and arrangement of these.

After the impact of the grenade, the tube 1, which is the most costly part, can be recovered in order to reconstruct a grenade ready for use. For this purpose, it is sufficient to remove the part of the nose 4 remaining in place on the tube, namely the connector 8. It is easier to remove the latter because the inner ribs 8*b* reduce the frictional surface with the end of the tube.

This operation can be carried out manually, without a tool, on the firing range itself.

Likewise, the reinstallation of a new nose on the tube can be carried out manually without any tool.

Of course, the invention is not limited to the exemplary embodiment just described, and many modifications can be made to the latter, without departing from the scope of the invention.

Thus, the form and arrangement of the embrittling zones 6 on the nose 4 can be modified.

Likewise, the fastening of the nose 4 on the end of the tube by engagement can be replaced by other means.

Thus, the connector 8 of the nose could have an internal thread capable of being screwed manually onto an external thread at the end of the tube.

We claim:

1. Completely inert training grenade intended to be fired by means of a rifle and of a propellant cartridge, comprising a metal tube (1) equipped with a rear stabilizing tail unit (2) and with a front solid part (3) which closes off said tube, this front part (3) carrying a hollow nose (4) containing a marking substance (5), this nose (4) being fastened removably by engagement to the front solid part (3) of the tube, this nose (4) being sufficiently resistant to withstand the shot, but being destructible on impact, wherein the solid front part (3) of the tube is produced in one piece with this tube, the diameter of this part being substantially equal to or slightly larger than that of the rest of the tube, wherein the nose (4) engaged on this solid front part has an inner annular shoulder (11) bearing on the front surface (3*a*) of the solid part (3) of the tube, and wherein the front end of the nose (4) is flat, this nose (4) being shaped so that its wall can break in the event of its impact on the ground, the nose (4) having a wall possessing thinned zones (6), said thinned zones (6) consisting of grooves made on the surface of the wall of the nose, said grooves (6) extending in the longitudinal direction of the nose.

2. The training grenade as claimed in claim 1, wherein the nose (4) is fastened to the tube (1) by means making it possible to remove the destroyed nose manually and to reinstall a new nose at any moment, especially on the firing range.

3. The training grenade as claimed in claim 1, wherein the nose (4) has a rear connector (8) which engages on the solid part (3) of the tube.

4. The training grenade as claimed in claim 3, wherein the thickness of the wall of the rear connector (8) is larger than that of the front part of the nose (4).

5. The training grenade as claimed in claim 4, wherein the front part of the nose (4) has a substantially frustoconical shape, the thickness of the wall of the nose (4) decreasing progressively between the large base and the small base of said frustoconical nose (4).

6. The training grenade as claimed in claim 1, wherein the nose (4) is molded in one piece from plastic.

7. The training grenade as claimed in claim 6, wherein said plastic is polystyrene.

8. The training grenade as claimed in claim 3, wherein the inner surface of the rear connector (8) of the nose (4) intended to be engaged on the solid part (3) of the tube (1) possesses, at its end adjacent to the actual nose, an annular shoulder (9) on which bears a plug or closing plate (10).

9. The training grenade as claimed in claim 1, wherein the tube (1) is produced in one piece from metal.

10. The training grenade as claimed in claim 9, wherein the solid part (3) of the tube is sufficiently resistant to stop the bullet of a live cartridge fired in error.

11. The training grenade as claimed in claim 1, wherein the bottom (17) of the tube (1) has an axial cavity (18) of a size matched to the end of a bullet.

12. The training grenade as claimed in claim 11, wherein the geometry and type of the metal of the solid part (3) and the shape of the cavity (18) are such that the solid part (3) can swell under the effect of the impact of a real bullet.

13. The training grenade as claimed in claim 9, wherein the rear tail unit (2) of the tube comprises a bush (14) carrying fins (15), this bush being engaged on the rear of the tube (1).

14. Completely inert training grenade intended to be fired by means of a rifle and of a propellant cartridge, comprising a metal tube (1) equipped with a rear stabilizing tail unit (2) and with a front solid part (3) which closes off said tube, this front part (3) carrying a hollow nose (4) allowance, and reconsideration and allowance are respectfully requested.

* * * * *